United States Patent [19]

Pietsch et al.

[11] Patent Number: 4,773,778

[45] Date of Patent: Sep. 27, 1988

[54] FABRIC PRINTER RIBBON COMPRISING A LIQUID VEHICLE CONTAINING A DECOLORIZABLE LEWIS ACID/LEWIS BASE COMPLEX

[75] Inventors: Guenter Pietsch, Isernhagen; Hubertus Greschenz, Hanover; Karl-Heinz Bohne, Isernhagen, all of Fed. Rep. of Germany

[73] Assignee: Pelikan Aktiengesellschaft, Hanover, Fed. Rep. of Germany

[21] Appl. No.: 868,434

[22] Filed: May 30, 1986

[30] Foreign Application Priority Data

Jun. 5, 1985 [DE] Fed. Rep. of Germany ..... 3520190

[51] Int. Cl.[4] ..... B41J 31/00

[52] U.S. Cl. ..... 400/241.1; 400/696; 428/914

[58] Field of Search ..... 400/237, 240, 241, 241.1, 400/241.2, 695, 696, 697, 697.1; 427/150, 151; 428/914

[56] References Cited

U.S. PATENT DOCUMENTS

| | | | |
|---|---|---|---|
| 1,905,118 | 4/1933 | Nadell | 400/696 |
| 2,217,349 | 10/1940 | Neidich | 503/202 |
| 3,941,488 | 3/1976 | Maxwell | 400/696 X |
| 3,968,320 | 7/1976 | Herber et al. | 427/150 X |
| 4,105,225 | 8/1978 | Neale et al. | 400/237 X |
| 4,172,727 | 10/1979 | Miyamoto et al. | 427/151 X |
| 4,252,845 | 2/1981 | Griffiths et al. | 400/696 X |
| 4,302,393 | 11/1981 | Garner et al. | 428/914 X |
| 4,309,255 | 1/1982 | Gendler et al. | 204/2 |
| 4,372,582 | 2/1983 | Geisler | 400/241.2 X |
| 4,413,266 | 11/1983 | Aviram et al. | 400/696 X |
| 4,529,993 | 7/1985 | Watanabe et al. | 427/150 X |
| 4,575,734 | 3/1986 | Kurisu et al. | 427/151 X |
| 4,639,271 | 1/1987 | Brunea et al. | 427/151 X |
| 4,641,160 | 2/1987 | Kondo et al. | 427/151 X |

FOREIGN PATENT DOCUMENTS

| | | | |
|---|---|---|---|
| 501145 | 3/1954 | Canada | 400/237 |
| 0032652 | 7/1981 | European Pat. Off. . | |
| 2809658 | 9/1979 | Fed. Rep. of Germany . | |
| 3300229 | 7/1983 | Fed. Rep. of Germany . | |
| 3440514 | 9/1985 | Fed. Rep. of Germany . | |
| 0016218 | 6/1979 | Japan | 400/241.2 |
| 0063194 | 4/1985 | Japan | 400/241.1 |
| 0097882 | 5/1985 | Japan | 400/696 |
| 565044 | 8/1975 | Switzerland | 400/237 |
| 664456 | 1/1952 | United Kingdom | 400/237 |
| 2022013 | 12/1979 | United Kingdom | 400/696 |

*Primary Examiner*—Ernest T. Wright, Jr.
*Attorney, Agent, or Firm*—Oblon, Fisher, Spivak, McClelland & Maier

[57] ABSTRACT

A fabric printer ribbon impregnated with a transfer medium comprised of a vehicle liquid and coloring agent dispersed in the vehicle liquid. The fabric printer ribbon may further contain property-improving additives. As the coloring agent, the ribbon contains a color reaction product in the form of a Lewis-acid/Lewis base color complex comprised of an organic chromogen and a color developer. The coloring agent is dissolved and/or dispersed as fine particles in the vehicle liquid. Such a fabric printer ribbon displays the advantage of correctability by means of an inhibitor of the color reaction. The corrected sheet can be typed over in customary fashion by means of the fabric printer ribbon in a second track of a fabric printer ribbon.

12 Claims, No Drawings

FABRIC PRINTER RIBBON COMPRISING A LIQUID VEHICLE CONTAINING A DECOLORIZABLE LEWIS ACID/LEWIS BASE COMPLEX

BACKGROUND OF THE INVENTION

1. Field of the Invention

The invention relates to a fabric printer ribbon, which is impregnated with a transfer medium comprised of a vehicle liquid and a coloring agent dispersed in the vehicle. The ribbon may further contain additives which improve its properties.

2. Discussion of the Background

Known printer ribbons, which are employed as ink ribbons or similar fabric printing media in typewriters, adding and calculating machines, punch card machines, computers, printers, addressing machines, and the like, contain ordinary coloring agents in the form of dyes and/or pigments. Current terminology used in the art will be followed rigorously. Accordingly, the term "coloring agent" comprises both dyes and pigments, with pigments being insoluble and dyes being soluble in the relevant solvents and/or binders. The dyes concerned are the classical organic and inorganic dyes. Such dyes are described in detail in various editions of "Coulour Index", 3rd Ed., 1971, pub. Society of Dyes and Colorists, Bradford, Yorkshire, England, and American Association of Textile Chemists and Colorists, Research Triangle Park, N.C., U.S.A.; and in "Schulzes Farbstofftabellen", 7th Ed., 1931, pub. Akademische Verlagsgesellschaft m.b.H., Leipzig.

Printer ribbon inks for monochrome ribbons are comprised chiefly of triturations of fat-soluble dyes or of lakes. In the case of document inks, triturations may also comprise carbon black, and the inks may further contain oils, fats, and fatty acids. Dyes for multicolored ribbons genrally have a somewhat different basic composition. For example, they should not contain oleic acid, which promotes diffusion into other color zones. The printer ribbon inks are generally applied to the ribbons after the printing process by means of ink ribbon impregnating machines. By this technique, the coloring of the colored ribbon occurs as the latter passes over a steel cylinder. A rubberized roll bearing the printer ribbon inks is pressed against the ribbon on one face of the ribbon, to apply the colored ink, and then the back side of the ribbon is inked on a second steel cylinder. By controlling the amount of ink and the pressure of the applied rubber rollers, or by inking the inked ribbon a number of times, any required ink intensity can be readily achieved, without damage to the fabric of the ribbon. Two-color and multicolor inked ribbons are produced by this technique. The inked ribbons are then wound up on spooling machines, where the ribbons are wound onto, e.g., typewriter ribbon spools.

The coloring agents described above have the advantage of providing durable inked printing. However, due to their chemical characteristics, there is no chemical correction means which can be used with them which does not damage the paper. This drawback has not yielded to research on suitable correction agents, despite many years of effort. Surprisingly, it has been discovered in connection with the present invention that by the choice of special coloring agents which can be gently bleached from the described paper, one can devise an advantageous fabric printer ribbon without detriment to the other desirable characteristics of commercial products currently in use. The known bleachable aqueous inks, i.e., extinguishable printer ribbon inks, are not suitable for this purpose. The extinction mechanism with such inks takes place solely in the aqueous phase.

SUMMARY OF THE INVENTION

The object of the present invention is a fabric printer ribbon impregnated with a transfer medium comprised of a vehicle liquid and a coloring agent dispersed in the liquid, and in which the ribbon may further contain additives which improve its properties.

The ribbon of the present invention contains, as a coloring agent, a color reaction product in the form of a Lewis acid/Lewis base color complex comprised of an organic chromogen and a color developer, dissolved and/or dispersed as fine particles, in the vehicle liquid.

DETAILED DESCRIPTION OF THE PREFERRED EMBODIMENTS

The inventive fabric printer ribbon thus differs from the known fabric printer ribbons basically in that an entire special coloring agent in the form of a color complex comprised of a certain chromogenic Lewis base and a corresponding developer in the form of a Lewis acid is employed. These two reaction partners react to form a coloring agent which, in the context of the invention, is dissolved in the vehicle liquid which is a nonaqueous medium. The color is extinguished in simple fashion, by applying, to the printed character which is to be corrected, an inhibitor for the color reaction which produces the color reaction product employed. This inhibitor is a compound which acts as a separate and distinct Lewis base and competes with the basic Lewis base chromogen. In the extinction process, the base inhibitor has a stronger affinity than the basic Lewis base chromogen for the Lewis acid which is in the form of a color developer. Due to the dynamic, i.e., reversible, course of the reaction, this competing reaction leads to the breakup of the dye complex and the substitution therefor of an achromatic complex comprised of the inhibitor and the color developer. The original chrologen is not a substantial chemical inhibitor of the complex comprising the inhibitor and the Lewis acid developer.

The following compounds are preferred as inhibitors: amines, amine oxides, quaternary ammonium compounds, oxonium compounds, polymeric alkylene glycols, and ethers of polymeric alkylene glycols.

Ethylene glycol with a molecular weight of about 4,000 to 6,000 has proven to be particularly suited as an inhibitor. This compound may be applied, e.g., in the form of a liquid solution, coming from a fiber marking pen, or in the form of a thin-layered paint-like coating with the aid of a brush. Other means of application are conceivable, e.g., wax pencil, roller-tip pen, etc. Other inhibitors may be employed correspondingly, with modifications as necessary or desirable. These modifications will be apparent to one skilled in the art. For re-typing the corrected area, one may provide a second track on the fabric printer ribbon, in which the track is impregnated with a customary printer ribbon ink. For the re-typing, then, this ink will not be extinguished as is the ink based on the color reaction product.

Examples of chromogen compounds in the context of the invention include compounds with a Lewis base character or with electron donor properties. Such compounds are known from their use in pressure-sensitive or heat-sensitive color reaction papers. Particular chromogens are obtained from, for example, the following classes of substances: leuco compounds based on auramine compounds, such as N-(2,5-dichlorophenyl)-leucauramine and N-benzoylleucauramine; diphenylmethane compounds, such as the p-toluenesulfinic acid of Mischler hydrol, bis(p-dimethylaminophenyl)-benzotriazolylmethane, bis(p-dimethylaminophenyl)-indolylmethane; lactone compounds, such as 3,3-bis(p-dimethylaminophenyl)-6-chlorophthalide, 3,3-bis(1-ethyl-2-methylindol-3-yl)-phthalide; fluoran compounds, such as 3-cyclohexylamino-6-chlorofluoran, 3-diethylamino-7-octaminofluoran, 3-diethylamino-7-dioctylaminofluoran, 3-diethylamino-7-dibenzylaminofluoran, 3-diethylamino- 7-(2-chloranilino)-fluoran, 3-dibutylamino-7-(2-chloroanilino)fluoran, 3-cyclohexylmethylamino-6-methyl-7-anilinofluoran, 3-(N-ethyl-p-toluidino)-6-methyl-7-anilinofluoran, 3-diethylamino-6-methyl-7anilinofluoran, 3-diethylamino-7-isobutylfluoran, and 3-methyl-2-phenylamino-6-pyrrolidinofluoran; spiropyran compounds, such as 3-phenyl-7-diethylamino-2,2'-spirodi[2H-1-benzopyran], and 1-phenyl-3,3-dimethylspiro[2'H-1'-benzopyran]-2,2'-indoline; phenothiazine compounds, such as N-benzoyl-leucomethylene blue; aminophenylpyridine compounds, such as 4-dimethylaminophenyl-2,6-diphenylpyridine; and diazaxanthene compounds, such as 3-diethylamino-6-dibutylaminodiazaxanthene lactone.

The choice of the corresponding color developer is not subject to any major limitations. The color developer must be such that a colored product is produced with the above enumerated chromogens. The color developer is dissolved and/or dispersed in the transfer medium employed according to the invention, and is dissolved or dispersed as fine particles in the selected vehicle liquid. Suitable color developers are Lewis acids and acid electron-acceptors, particularly phenolic compounds, inorganic and organic acids, and metal salts and esters of these acids. There are no major limitations on the choice of alcohol in the esterification of these acids. Thus, for example, lower alcohols, such as methanol, ethanol, propanol, butanol, and the like may be used, as well as higher alcohols such as fatty alcohols, or even aromatic compounds with alcohol groups. The following compounds have proven to be particularly suited as color developers for the purposes of the invention: alkylphenols, particularly p-tert-butylphenol; dihydroxybiphenyls, particularly 2,2'-dihydroxybiphenyl, 4,4'-dihydroxybiphenyl, 3,3'-dimethyl-4,4'-dihydroxybiphenyl, and 3,3'-dibenzyl-4,4'-dihydroxybiphenyl; phenol ethers, particularly p-hydroxydiphenyl ether; naphthols, particularly 1-hydroxynaphthalene and 2-hydroxynaphthalene; dihydroxybenzenes, particularly substituted or unsubstituted pyrocatechol and resorcinol; alkylidenebisphenols, such as methylenebisphenols, isopropylidenebisphenols, butylidenebisphenols, and cyclohexylidenebisphenols; hydroxybenzoic acids, including metal salts and esters of these acids; thiosalicylic acids, including metal salts and esters of these acids; thiobisphenol isomers, e.g., 4,4'-thiobisphenol; hydroxynaphthoic acids, including metal salts of these acids; phthalic acid derivatives, particularly phthalic acid monoethylhexyl ester and the zinc salt of this acid; low molecular weight oil-soluble alkylphenol/formaldehyde and arylphenol/formaldehyde resins, and metal complexes of these resins, particularly zinc(II) p-phenylphenol/formaldehyde resin and zinc(II) t-butylphenol/formaldehyde resin.

In particular cases it may also be of advantage to bring compounds into the transfer medium of the inventive fabric printer ribbon which are insoluble acids, or insoluble acid-reacting compounds, or compounds having a Lewis character. These are achromatic or only slightly colored. Their function is to increase the lightfastness of the color complex.

Solid, acidic Lewis acids with a large interior and exterior surface area are preferred additives for increasing the light fastness of the color complex in the transfer medium. These solid Lewis acids are preferably present in the form of argillaceous minerals, silicates and/or metal oxides. Specifically preferred solid Lewis acids are bentonite, attapulgite and montmorillonite.

The vehicle liquid employed in connection with the invention must satisfy the same requirements as such liquids in ordinary fabric printer ribbons. Thus, it should have a high boiling point and low vapor pressure, not be sublimable, be odorless or at least not have an objectionable odor, have low viscosity preferably less than 1500 mPa, be nontoxic, and be a good solvent for the coloring agent. Further, it should not comprise drying oils or semi-drawing oils. These general criteria are satisfied by many compounds.

The following classes of compounds have proven to be suited for use as the vehicle liquid: phosphoric acid esters, citric acid esters, benzoic acid esters, phthalic acid esters, sebacic acid esters, adipic acid esters, fatty acid esters, arylsulfonamides, alkanols, and fatty acids.

In particular, the candidates for vehicle liquid include those known for many years and used in pressure-sensitive color reaction papers. Examples of these are: aromatic derivatives, such as substituted benzenes, particularly dodecylbenzene; substituted biphenyls, particularly diisopropylbiphenyl and monoisobutylbiphenyl; terphenyls, such as hexahydro- or dodecahydroterphenyl; and naphthalenes, particularly dialkylnaphthalenes, more particularly diisopropylnaphthalene and methylisobutyl-naphthalene; halogenated alkanes, particularly chloroparaffins with 20–60 wt. % chlorine and 8 to 30 C atoms; and hydrocarbonchlorosulfonic acid esters.

Particularly suitable examples of vehicle liquids are: dodecylbenzene, monoisopropylbiphenyl, amylbiphenyl, hexahydroterphenyl, dodecahydroterphenyl, diisopropylnaphthalene, methyl-isobutyl-naphthalene, phenyl-xylyl-ethane, dibenzylbenzene, dibenzyltoluene, dimethylthianthrene, ditolyl sulfide, diphenoxyethylformal, paraffinsulfonic acid aryl esters, phenyl esters of chlorosulfonated hydrocarbons, chlorinated paraffins having a degree of chlorination of 20–60% and 8–30 C atoms per molecule, tricresylphosphate, diphenyl octyl phosphate, diisobutylphthalate, dioctyl-phthalate, dimethoxyethyl phthalate, butyl-benzyl-phthalate, didecyl-phthalate, ethylene glycol phthalate, acetyl tri-n-butyl citrate, dioctyl-sebacate, dipropylene glycol dibenzoate, dioctyl-adipate, diisodecyl-adipate, di-(2-ethylhexyl)adipate, ortho- and para-toluene-ethylsulfonamide, 2-phenylethanol, 2-octyldodecanol, butylstearate, butylacetylricinolate, castor oil, polyethylene glycol 400 dilaurate, and oleic acid. The preferred chloroparaffins among those mentioned are those having a degree of chlorination of forty wt. % and having 20–24 C atoms.

In such a vehicle liquid, the inventively employed coloring agent is used in the form of the color complex in an amount of up to about 50 wt. %. The amount of coloring agent used is obviously a function of the given combination of color complex and vehicle liquid. In particular cases, this limit may be exeeded. However, as a rule it is preferred that the color complex be dissolved in the vehicle liquid in an amount of about 30–40 wt %. The dissolution can be carried out by stirring at elevated temperature. However, the temperature should not be raised to the extent that the color complex is broken up. The transfer medium obtained in this manner is applied to the selected fabric ribbon by impregnation, for example, as in the manner described above.

Finally, additives may be incorporated in the transfer medium or vehicle liquid, to improve the properties of the inventive fabric printer ribbon and the color complex contained in the ribbon, particularly the viscosity, flowability, and creep strength of the transfer medium, and to improve the sharpness and light-fastness of the printed characters.

Additives for improving viscosity [e.g. hydrocarbon resines, preferably polyisobutenes (trademark Oppanole) and vaseline], flowability [e.g. natural and synthetic non-iongenic wetting agents, preferably soylecithin and derivatives thereof, e.g. Colorol F (trademark), polyethylene glycolethers, alkyl aryl polyglycolethers, phosphoric esters, polyoxyethylene sorbitan esters] and creep strength (blown oils, preferably blown poppy oil, colza oil and sperm oil and sorbitan trioleate) can be used and are known to one skilled in the art relating to ordinary fabric printer ribbons. But these additional substances should be selected as a function of the obligatory compounds of the invention, i.e. they should be matched to it.

The printed characters obtained with the inventive fabric printer ribbon meet the usual requirements applied to characters produced by ordinary fabric printer ribbons. They have been evaluated from the standpoint of light-fastness, wipe-fastness, storage stability, intensity index, and yield.

Other features of the invention will become apparent in the course of the following descriptions of exemplary embodiments which are given for illustration of the invention and are not intended to be limiting thereof.

EXAMPLE 1

The following mixture was prepared (amounts given are parts by weight):

3-Di-N-butylamino-7-(2-chloroanilino)-fluoran: 10
Zinc 3,5-diisopropylsalicylate: 30
Dipropylene glycol dibenzoate: 60

The oil phase, dipropylene glycol dibenzoate, was charged into a mixing vessel at room temperature, and the chromogen and the color developer were added under stirring. The mixture was heated to 80° C., with continued stirring, and was allowed to react 2 hours at that temperature. The result after cooling was a viscous, intensely black colored liquid.

A nylon fabric ribbon 13 mm wide, about 105 microns thick, and having a weave structure of 49 warp and 45 weft threads per cm was impregnated with 15 g of the above-described printer ribbon ink per square meter.

The resulting ribbon produced outstanding print with ordinary typewriters. The color of the print could be extinguished in simple fashion by means of suitable inhibitors.

EXAMPLE 2

The following formulation was processed to produce a printer ribbon ink as in Example 1 (amounts given are parts by weight):

3-Di-N-butylamino-7-(2-chloroanilino)-fluoran: 9.5
3,3-Bis(p-dimethylaminophenyl)-6-dimethylaminophthalide: 0.5
Zinc 3,4-dichlorobenzoate: 27.0
Isostearic acid: 63.0

A fabric ribbon was impregnated with this formulation. The resulting colored characters were of a deep black color. They were extinguished in simple fashion compared with ordinary markings from fabric printer ribbons.

EXAMPLE 3

The following enumerated substances were used to prepare a printer ribbon ink according to the method of Example 1 (amounts given are parts by weight):

3-Diethylamino-7-n-octylaminofluoran: 9.7
3,3-Bis(isooctyl-2'-methylindol-3'-yl)phthalide: 0.3
3,3-Bis(p-dimethylaminophenyl)-6-dimethylaminophthalide: 0.3
4-Dimethylaminophenyl-2,6-diphenylpyridine: 0.2
Zinc 3,5-diisopropylsalicylate: 25.0
Zinc p-phenylphenol/formaldehyde resin: 4.5
Butyl benzyl phthalate: 20.0
Alkylsulfonic acid esters of phenol and cresol: 41.0

A fabric printer ribbon prepared with this formulation produced outstanding colored characters of high intensity, which could be rendered colorless (extinguished) upon treatment with suitable inhibitors.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A fabric printer ribbon impregnated with a transfer medium, comprised of (i) a vehicle liquid and (ii) a coloring agent dispersed in said vehicle liquid, wherein said ribbon contains, as a coloring agent, a color reaction product substantially combined in the form of a Lewis acid/Lewis base color complex comprised of a color developer and an organic chromogen, respectively, and wherein said color developer is dissolved or dispersed as fine particles, in said vehicle liquid.

2. The fabric printer ribbon of claim 1, wherein said chromogen is at least one chromogen in the form of a leuco compound selected from the group consisting of auramines, diphenylmethanes, lactones, phthalides, fluorans, spiropyrans, phenothiazines, aminophenylpyridines, and diazaxanthenes.

3. The fabric printer ribbon of claim 2, wherein said chromogen is comprised of at least one member selected from the group consisting of 3,3-bis(1'-octyl-2'-methylindol-3'-yl)phthalide, 3-cyclohexylamino-6-chlorofluoran 3-diethylamino-7-octylaminofluoran, 3-diethylamino-7-dioctylaminofluoran, 3-diethylamino-7-dibenzylaminofluoran, 3-diethylamino-7-(2-chloranilino)fluoran, 3-dibutylamino-7-(2-chloranilino)-fluoran, 3-cyclohexylmethylamino-6-methyl-7-anilinofluoran, 3-(N-ethyl-p-toluidino)-6-methyl- 7-anilinofluoran, 3-diethylamino-6-methyl-7-anilinofluoran, 3-diethylamino-7-isobutylfluoran, 3-phenyl-7-diethylamino-2,2'-spirodi[2H-1-benzopyran], 3-methyl-2-phenylamino-6-pyrrolidinofluoran, and 4-dimethylaminophenyl-2,6-diphenylpyridine.

4. The fabric printer ribbon of claim 1, wherein said color developer is a member selected from the group consisting of phenolic compounds, metal salts and esters of phenolic compounds, carboxylic acids, and metal salts and esters of carboxylic acids.

5. The fabric printer ribbon of claim 4, wherein said color developer is at least one member selected from the group consisting of alkylphenols, arylphenols, phenol ethers, naphthols, alkylidenebisphenols, hydroxybenzoic acids, derivatives of hydroxybenzoic acids, thiosalicylic acids, naphthoic acid derivatives, phthalic acid derivatives, low molecular weight soluble alkylphenol/formaldehyde resins, low molecular weight soluble arylphenol/formaldehyde resins, metal complexes of said resins, and complexes of said resins with zinc compounds.

6. The fabric printer ribbon of claim 1, wherein said vehicle liquid comprises at least one compound selected from the group consisting of substituted derivatives of benzene, biphenyl, terphenyl, naphthalene, diphenylalkanes, haloalkanes, phosphoric acid esters, citric acid esters, benzoic acid esters, phthalic acid esters, sebacic acid esters, adipic acid esters, fatty acid esters, arylsulfonamides, alkanols, and fatty acids.

7. The fabric printer ribbon of claim 6, wherein said vehicle liquid is at least one member selected from the group consisting of dodecylbenzene, monoisopropylbiphenyl, amylbiphenyl, hexahydroterphenyl, dodecahydroterphenyl, diisopropylnaphthalene, methyl-isobutyl-naphthalene, phenyl-xylyl-ethane, dibenzylbenzene, dibenzyltoluene, dimethylthianthrene, ditolylsulfide, diphenoxyethylformal, paraffinsulfonic acid aryl esters, phenyl esters of chlorosulfonated hydrocarbons, chlorinated paraffins having a degree of chlorination of 20–60% and 8–30 C atoms per molecule, tricresylphosphate, diphenyl-octyl-phosphate, diphenyl-octyl-phosphate, diisobutylphthalate, dioctyl-phthalate, di-methoxyethylphthalate, butyl-benzyl-phthalate, didecyl-phthalate, ethylene glycol phthalate, acetyl tri-n-butyl citrate, dioctyl-sebacate, dipropylene glycol dibenzoate, dioctyl-adipate, diisodecyl-adipate, di-(2-ethylhexyl)adipate, ortho- and para-toluene-ethylsulfonamide, 2-phenylethanol, 2-octyldodecanol, butylstearate, butylacetylricinolate, castor oil, polyethylene glycol 400 dilaurate, and oleic acid.

8. The fabric printer ribbon of claim 1, further comprising an additive for improving the viscosity, flowability, creep strength of said transfer medium and for improving the sharpness or light fastness of a printed character.

9. The fabric printer ribbon of claim 8, wherein said additive is a solid, acidic Lewis acid with a large interior and exterior surface area.

10. The fabric printer ribbon of claim 9, wherein said solid acidic Lewis acid is present in the form of an argillaceous mineral, silicate or metal oxide.

11. The fabric printer ribbon of claim 10, wherein said argillaceous mineral is bentonite, attapulgite or montmorillonite.

12. The fabric printer ribbon of claim 5, wherein said derivatives of hydroxybenzoic acids are metal salts or esters.

* * * * *